US011814864B1

(12) United States Patent
Shi

(10) Patent No.: US 11,814,864 B1
(45) Date of Patent: Nov. 14, 2023

(54) POOL

(71) Applicant: DONGGUAN HONGYU PLASTIC CO., LTD, Dongguan (CN)

(72) Inventor: Juying Shi, Dongguan (CN)

(73) Assignee: DONGGUAN HONGYU PLASTIC CO., LTD, Dongguan (CN)

( * ) Notice: Subject to any disclaimer, the term of this patent is extended or adjusted under 35 U.S.C. 154(b) by 0 days.

(21) Appl. No.: 18/147,013

(22) Filed: Dec. 28, 2022

(30) Foreign Application Priority Data

Oct. 28, 2022 (CN) ..... 202222873376.6

(51) Int. Cl.
*E04H 4/00* (2006.01)
*E04H 4/12* (2006.01)

(52) U.S. Cl.
CPC ..... *E04H 4/0043* (2013.01); *E04H 4/12* (2013.01)

(58) Field of Classification Search
CPC ..... E04H 4/0031; E04H 4/12
USPC ..... 4/509
See application file for complete search history.

(56) References Cited

U.S. PATENT DOCUMENTS 5,592,702 A * 1/1997 Gillebaard, Jr. ..... E04H 4/0056 4/585
10,508,461 B1 * 12/2019 Sadowy ..... F16B 1/00
2004/0040082 A1 * 3/2004 Fireman ..... E04H 4/0025 4/506
2020/0277803 A1 * 9/2020 Cohen ..... B29C 70/682
2021/0324648 A1 * 10/2021 Huang ..... E04H 4/0056
2021/0348409 A1 * 11/2021 Chen ..... F16B 7/042
2022/0162871 A1 * 5/2022 Ramos ..... E04H 4/14

* cited by examiner

*Primary Examiner* — Christine J Skubinna

(57) ABSTRACT

A pool is provided, including an enclosure body, a sealing plate, and a plurality of shaping plates, wherein the enclosure body is of an annular structure with two open ends, the enclosure body is provided with a plurality of receiving cavities in a circumferential direction thereof, and the plurality of shaping plates are respectively arranged in the plurality of receiving cavities in one-to-one correspondence; the enclosure body is connected to the sealing plate, and the sealing plate seals one of the two ends of the enclosure body, so that the enclosure body and the sealing plate define a water storage cavity together.

13 Claims, 5 Drawing Sheets

POOL

CROSS-REFERENCE TO RELATED APPLICATION

The present disclosure claims the priority to a Chinese patent application with the filing No. 202222873376.6 filed with the Chinese Patent Office on Nov. 1, 2022 and entitled "Novel Pool", the contents of which are incorporated herein in entirety by reference.

TECHNICAL FIELD

The present disclosure relates to the field of recreation facility, particularly to a pool.

BACKGROUND ART

Bracket pool is formed by combining a steel frame and fabric, so it is thus named. The bracket pool can be customized according to customers' site requirements. The bracket pool is mainly used in park squares. In scorching summer, fixed natatoria are in great demand, then the operation problem raises. The emergence of bracket pools has improved this situation. As the bracket pools are not easily restricted by site factors and are convenient to transport, and thus have a wide range of application. In the prior art, the outside of the bracket pool is the steel frame, the inside is a fabric layer, the fabric layer is supported and positioned by the steel frame, and the fabric layer can define a water storage area.

Upon researches the inventor found that the bracket pool in the prior art has the following disadvantages.

The bonding between the steel frame and the fabric is not tight enough, many large gaps exist between the fabric and the steel frame, and the connection between the fabric and the steel frame is poor in firmness, resulting in that the pool is not structurally stable enough and is inconvenient to use.

SUMMARY

An embodiment of the present disclosure provides a pool, including: an enclosure body, a sealing plate, and a plurality of shaping plates, wherein the enclosure body is of an annular structure with two open ends, the enclosure body is provided with a plurality of receiving cavities in a circumferential direction thereof, and the plurality of shaping plates are respectively arranged in the plurality of receiving cavities in one-to-one correspondence; the enclosure body is connected to the sealing plate, and the sealing plate seals one of two ends of the enclosure body, so that the enclosure body and the sealing plate define a water storage cavity together.

In an optional embodiment, the enclosure body includes an inner peripheral layer, an outer peripheral layer, and an annular sealing layer, the outer peripheral layer is sheathed outside the inner peripheral layer, the inner peripheral layer and the outer peripheral layer define therebetween an annular space with two open ends, the annular sealing layer is connected to both the inner peripheral layer and the outer peripheral layer, so as to seal one end of the annular space; and the inner peripheral layer and the outer peripheral layer are both hermetically connected to the sealing plate, and the sealing plate seals the other end of the annular space.

In an optional embodiment, a plurality of blocking portions arranged in a circumferential direction of the annular space are provided between the inner peripheral layer and the outer peripheral layer, and the inner peripheral layer, the outer peripheral layer, and adjacent blocking portions together define one of the receiving cavities.

In an optional embodiment, the blocking portions are provided as welding seams, bonding seams, or stitching seams.

In an optional embodiment, the enclosure body has a first end and a second end in an axial direction thereof, the first end is connected to the sealing plate; the second end is provided with a plurality of operation ports configured to be capable of being switched between an open state and a closed state; and the plurality of operations ports are in one-to-one correspondence and communication with the plurality of receiving cavities.

In an optional embodiment, the enclosure body is provided thereon with a plurality of cover bodies, the plurality of cover bodies are in one-to-one correspondence with the plurality of operation ports, and each of the cover bodies is configured to open or close the corresponding operation port.

In an optional embodiment, each of the cover bodies is configured as a flexible member, one side of the cover body is fixedly connected to the enclosure body, and the other side is detachably connected to the enclosure body by a velcro tape assembly (magic tape assembly), a button assembly, or a zipper assembly.

In an optional embodiment, the pool further includes a reinforcement belt, and the reinforcement belt is sheathed outside the outer peripheral surface of the enclosure body.

In an optional embodiment, a plurality of limiting belts are provided on the outer peripheral surface of the enclosure body, the plurality of limiting belts are arranged at intervals in the circumferential direction of the enclosure body, each of the limiting belts and the enclosure body together define a limiting through-hole, and the reinforcement belt passes through the plurality of limiting through-holes, so as to limit displacement of the reinforcement belt in an axial direction of the enclosure body.

In an optional embodiment, the pool further includes a circulation pipe and a filter pump provided on the circulation pipe, and two ends of the circulation pipe are both in communication with the water storage cavity.

In an optional embodiment, a step is provided at the bottom of the sealing plate, and is configured to allow that a shallow water area and a deep water area can be formed in the pool after water injection.

In an optional embodiment, a drainage valve is provided on a top portion of the sealing plate, and is configured to be capable of being connected to a quick connector so as to be connected to a pipeline, and discharge water in the water storage cavity of the pool is through the pipeline.

In an optional embodiment, each of the blocking portions is of a strip-shaped structure, and extends in the axial direction of the annular space.

In an optional embodiment, the length of each of the blocking portions is less than the height of the annular space.

In an optional embodiment, each of the shaping plates has a shape substantially consistent with that of corresponding receiving cavity.

In an optional embodiment, an inner edge of the annular sealing layer is hermetically connected to the inner peripheral layer in a heat-seal welding manner, and an outer edge of the annular sealing layer is hermetically connected to the outer peripheral layer in a heat-seal welding manner.

In an optional embodiment, the inner peripheral layer and the outer peripheral layer are both fixedly connected to the sealing plate in a heat-seal welding manner.

In an optional embodiment, two ends of the reinforcement belt are detachably connected with each other by a quick buckle.

In an optional embodiment, two ends of the circulation pipe both penetrate through the inner peripheral layer, the shaping plates, and the outer peripheral layer, and the two ends of the circulation pipe have a height difference.

In an optional embodiment, in the two ends of the circulation pipe, one end having a lower height is a water suction end, and is configured to suck water in the water storage cavity after the filter pump is started, and the other end having a higher height is a water outlet end, and is configured to discharge the water sucked from the water suction end and filtered by the filter pump, to return the water to the water storage cavity.

BRIEF DESCRIPTION OF DRAWINGS

In order to more clearly illustrate technical solutions of embodiments of the present disclosure, drawings which need to be used in the embodiments will be introduced below briefly, and it should be understood that the drawings below merely show some embodiments of the present disclosure, and thus should not be considered as limitation to the scope, and a person ordinarily skilled in the art still could obtain other relevant drawings according to these drawings, without using any creative effort.

REFERENCE SIGNS

Figure 1:
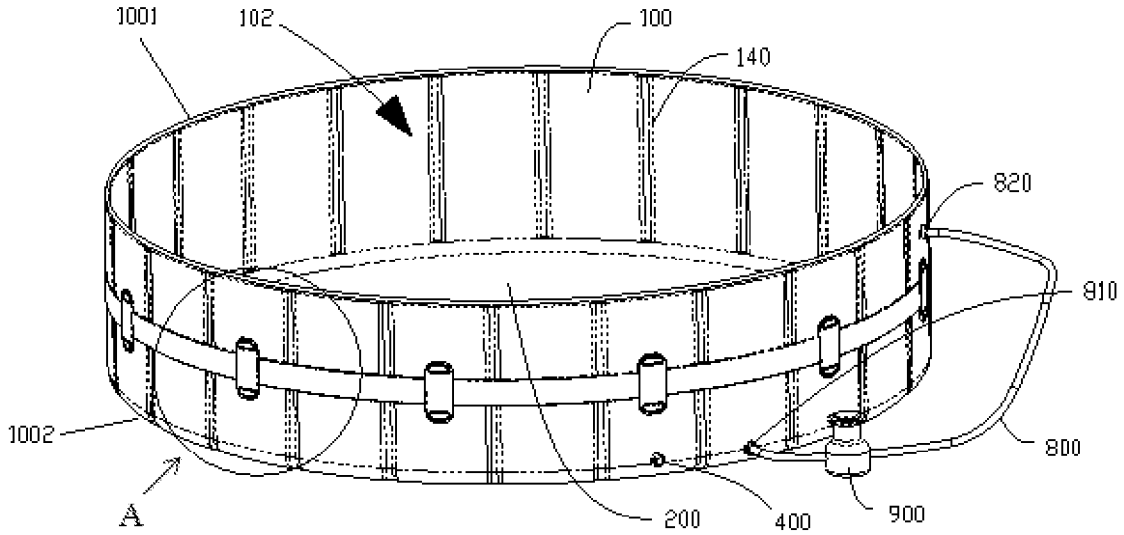
FIG. 1 is a structural schematic view of a pool according to an embodiment of the present disclosure.

100—enclosure body; 1001—first end; 1002—second end; 101—receiving cavity; 102—water storage cavity; 110—inner peripheral layer; 120—outer peripheral layer; 130—annular sealing layer; 131—operation port; 140—blocking portion; 200—sealing plate; 300—shaping plate; 400—drainage valve; 500—cover body; 600—reinforcement belt; 700—limiting belt; 800—circulation pipe; 810—water suction end; 820—water outlet end; 900—filter pump.

DETAILED DESCRIPTION OF EMBODIMENTS

In order to make objectives, technical solutions, and advantages of the embodiments of the present disclosure clearer, the technical solutions in the embodiments of the present disclosure will be described clearly and completely below in conjunction with the drawings in the embodiments of the present disclosure, and apparently, some but not all embodiments of the present disclosure are described. Generally, components in the embodiments of the present disclosure described and shown in the drawings herein may be arranged and designed in different configurations.

Therefore, the detailed description below of the embodiments of the present disclosure provided in the drawings is not intended to limit the scope of protection of the present disclosure, but merely represents chosen embodiments of the present disclosure. Based on the embodiments of the present disclosure, all of other embodiments, obtained by a person ordinarily skilled in the art without any creative effort, shall fall within the scope of protection of the present disclosure.

It should be noted that similar reference signs and letters represent similar items in the following drawings, therefore, once a certain item is defined in one drawing, it is not needed to be further defined or explained in subsequent drawings.

In the description of the present disclosure, it should be indicated that orientation or positional relations indicated by terms such as "center", "up", "down", "left", "right", "vertical", "horizontal", "inside", and "outside" are based on the orientation or positional relations shown in the drawings, or orientation or positional relations in which the product of the present disclosure is placed conventionally in use, only for facilitating description of the present disclosure and simplifying the description, rather than indicating or implying that the referred devices or elements must be in a particular orientation or constructed or operated in the particular orientation, and therefore they should not be construed as limitation to the present disclosure. Besides, terms "first", "second", "third", etc. are merely for distinguishing the description, but should not be construed as indicating or implying importance in the relativity.

Moreover, terms "horizontal", "vertical" and the like do not mean that the parts are required to be absolutely horizontal or overhanging, but may be slightly inclined. For example, by "horizontal" it merely means that a structure is more horizontal in comparison with "vertical", rather than being completely horizontal, while the structure can be slightly inclined.

In the description of the present disclosure, it should be further illustrated that, unless otherwise specifically regulated and defined, the terms "set", "install", "link", and "connect" should be understood in a broad sense, for example, a connection may be a fixed connection, a detachable connection, or an integrated connection; it may be a mechanical connection or an electrical connection; it may be direct joining or indirect joining through an intermediary, and it also may be internal communication between two elements. For those ordinarily skilled in the art, specific meanings of the above-mentioned terms in the present disclosure could be understood according to specific circumstances.

At present, a bracket pool includes a steel frame outside and an inner layer of fabric, the steel frame is formed by connecting multiple section bars (profiles) by means of quick buckles, and the steel frame is arranged in a ring shape. The inner layer of fabric is located at an inner side of an area enclosed by the steel frame, connectors are provided on the fabric, and the connectors are connected to the steel frame through structures such as screws. In this way, when the bracket pool is used, the steel frame needs to be set up, and then the fabric is arranged at the inner side of the steel frame, thus the operations are complicated and inconvenient. Moreover, connection positions of the fabric and the steel frame are substantially arranged at intervals, the bonding between the fabric and the steel frame is not tight enough, thus the firmness and the stability are poor, which causes it inconvenient to use the pool.

In view of this, the inventor of the present disclosure provides a pool, which can improve the stability of the pool structure, is convenient to use, and has high safety and good reliability during use. Meanwhile, the assembling of the pool is convenient, saving time and labor.

Figure 2:
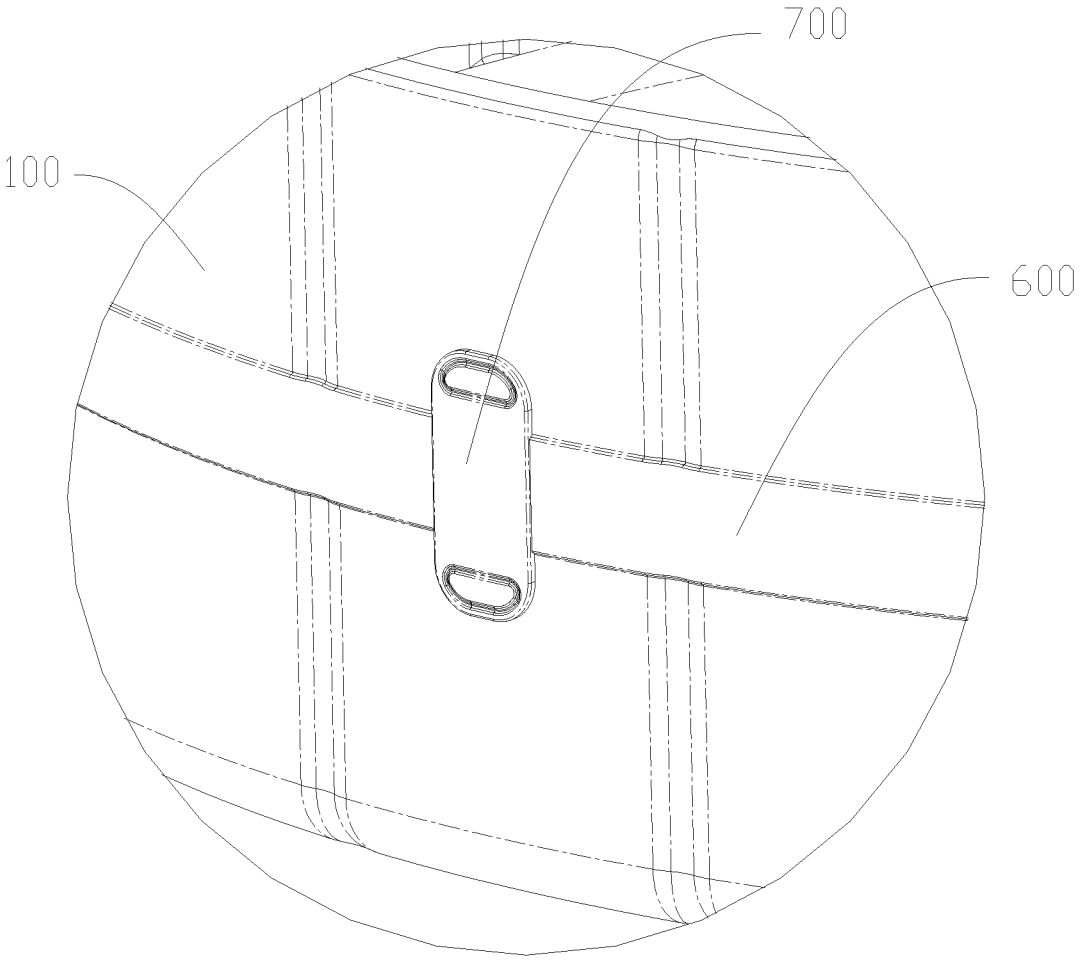
FIG. 2 is a partial enlarged structural schematic view of part A in FIG. 1.
Figure 3:
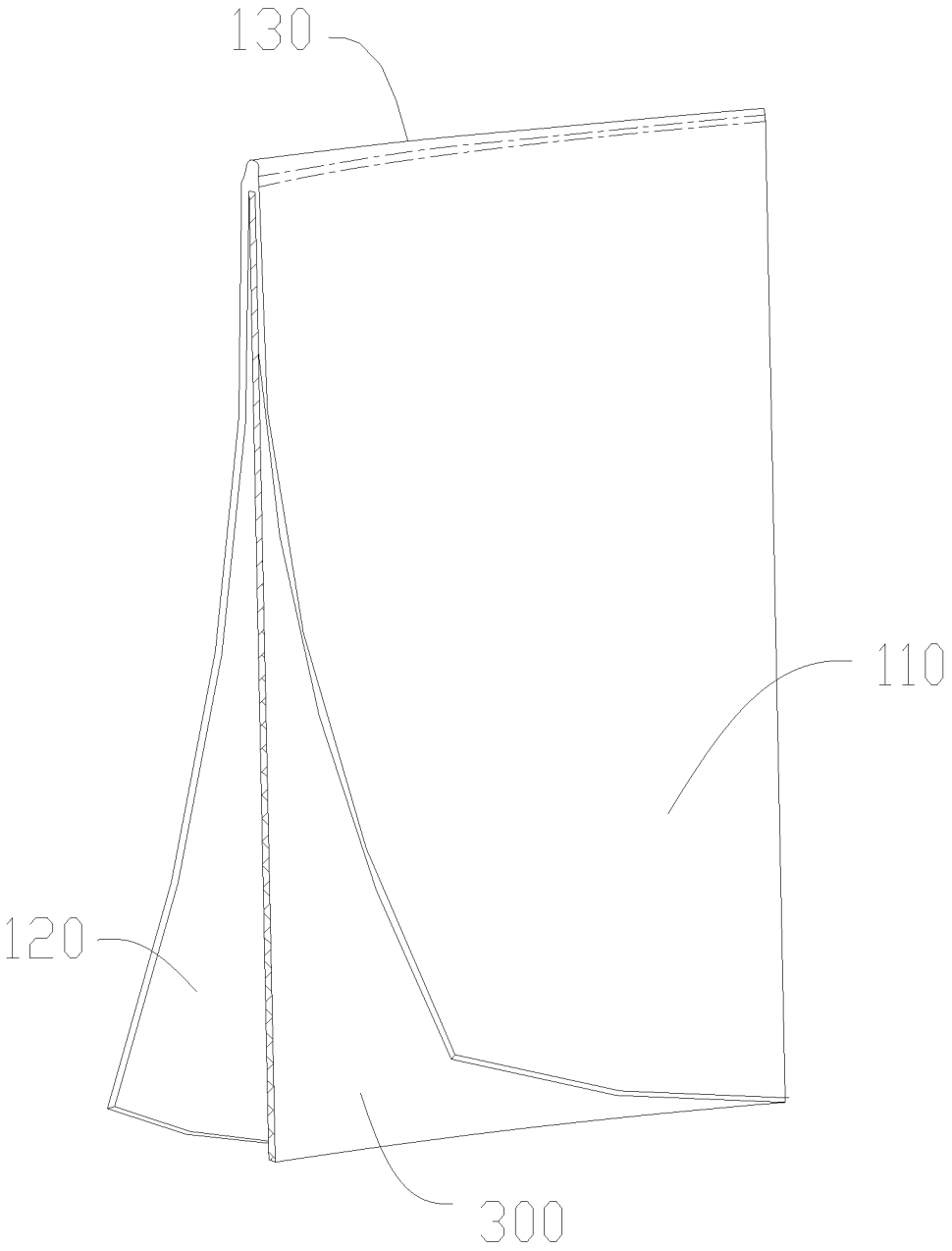
FIG. 3 is a partial structural schematic view of the pool according to an embodiment of the present disclosure.

Referring to FIG. 1 to FIG. 3, in the present embodiment, the pool includes an enclosure body 100, a sealing plate 200, and a plurality of shaping plates 300. The enclosure body 100 is of an annular structure with two open ends, the enclosure body 100 is provided with a plurality of receiving cavities 101 in a circumferential direction thereof, and the plurality of shaping plates 300 are respectively arranged in the plurality of receiving cavities 101 in one-to-one correspondence. The enclosure body 100 is connected to the sealing plate 200, and the sealing plate 200 seals one of two ends of the enclosure body 100, so that the enclosure body 100 and the sealing plate 200 define a water storage cavity 102 together.

The pool provided in the present embodiment has at least the following advantages:

by providing the plurality of shaping plates 300 all in the plurality of receiving cavities 101 of the enclosure body 100, that is, the number of the shaping plates 300 is equal to the number of the receiving cavities 101, and each shaping plate 300 is provided in one corresponding receiving cavity 101, a plurality of surfaces of the shaping plates 300 can be all in contact with the enclosure body 100, the shaping plates 300 and the enclosure body 100 have large contact areas, and tightly fit with each other, so that the bonding between the shaping plates 300 and the enclosure body 100 is stable and reliable, the two are not easy to be separated from each other, the pool assembled has high stability and high safety during use. In use, the sealing plate 200 is positioned on a top surface or other supports, and then a certain amount of water is injected into the water storage cavity 102. After water is injected, under the pressure of water, the sealing plate 200 is positioned, the enclosure body 100 is subjected to an external force making it expand outwardly, and the enclosure body 100 of an annular structure is reinforced by the shaping plates 300, so that the shape of the enclosure body 100 is stabilized, thus the pool can be used normally.

It should be understood that, the height of water level in the water storage cavity 102 is set as required, and a step can be provided at the bottom of the sealing plate 200, so that a shallow water area and a deep water area can be formed in the pool after water injection, facilitating the user in selecting and using the same.

In addition, a drainage valve 400 further can be provided on a top portion of the sealing plate 200. When needing to clean or store the pool, the drainage valve 400 is opened to discharge the water in the pool from the drainage valve 400. It should be noted that a quick connector can be provided at the drainage valve 400, and the quick connector can be connected to a pipeline, so that the water in the pool is guided to a designated position through the pipeline, thereby preventing the water from flowing around and contaminating the environment, also facilitating the recycling of water resources, and improving the utilization rate of resources.

In the present embodiment, optionally, the enclosure body 100 may be configured as an integrated structure, or the enclosure body 100 is configured as a split structure and then assembled. For example, in the present embodiment, illustration is made by taking the enclosure body 100 of a split structure as an example.

Figure 4:
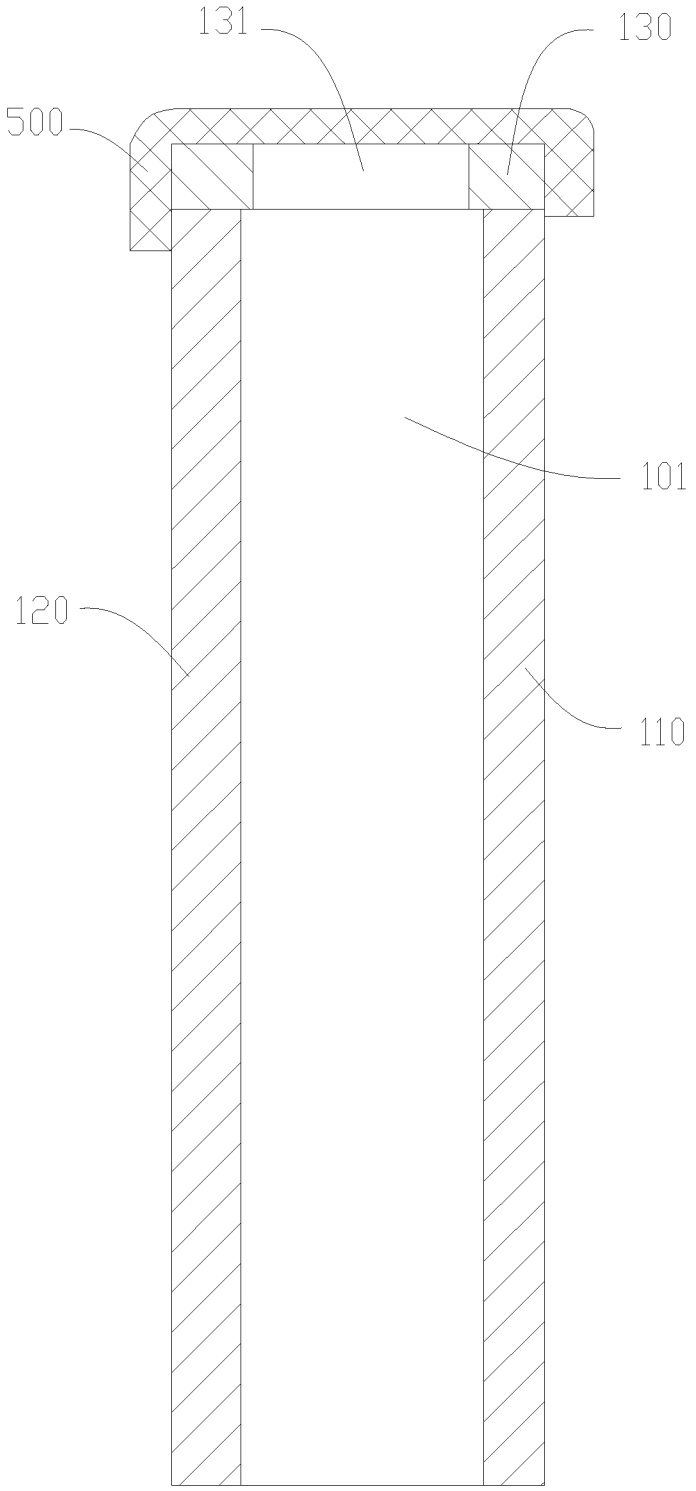
FIG. 4 is a structural schematic view of cooperation between an enclosure body and a cover body according to an embodiment of the present disclosure.
Figure 5:
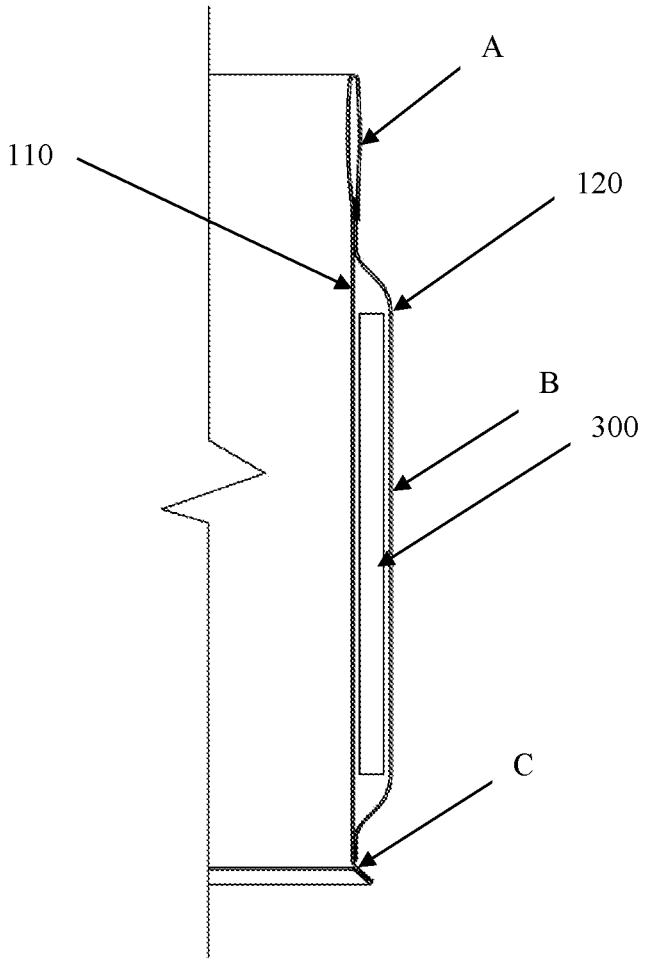
FIG. 5 is a cross-section A-A of a single plate of the enclosure body 100 in FIG. 4.

Referring to FIG. 1 and FIG. 4, the enclosure body 100 includes an inner peripheral layer 110, an outer peripheral layer 120, and an annular sealing layer 130. In the above, the inner peripheral layer 110 and the outer peripheral layer 120 are both in a round ring shape, and the annular sealing layer 130 is in a round ring shape. The outer peripheral layer 120 is sheathed outside the inner peripheral layer 110, the outer peripheral layer 120 and the inner peripheral layer 110 are co-axially arranged, the two together define an annular space with two open ends, and a profile of the cross section of the annular space is in a round ring shape, wherein the cross section is a plane perpendicular to the axis of the annular space, and the axis of the annular space is collinear with the axis of the inner peripheral layer 110 or the outer peripheral layer 120. Moreover, a plurality of blocking portions 140 are provided between the inner peripheral layer 110 and the outer peripheral layer 120, each blocking portion 140 is of a strip-shaped structure, each blocking portion 140 extends in an axial direction of the annular space, and two ends of each blocking portion 140 are substantially flush with two ends of the annular space. The plurality of blocking portions 140 are evenly spaced and arranged in a circumferential direction of the annular space. It should be noted that the blocking portions 140 may be welding seams, bonding seams, stitching seams, or the like. In other words, the inner peripheral layer 110 and the outer peripheral layer 120 may be provided with a plurality of welding positions, and at each welding position, the inner peripheral layer 110 and the outer peripheral layer 120 are made to be welded and fixed together in a heat seal manner, in this way, a welding seam is formed at each heat-seal welding position, and the welding seam is just the blocking portion 140. By the same reasoning, the inner peripheral layer 110 and the outer peripheral layer 120 can be fixed with each other in a bonding manner, and a bonding seam is formed at the bonding position. Alternatively, the inner peripheral layer 110 and the outer peripheral layer 120 may be fixed together by means of stitching, and a stitching seam is formed at the stitching position. It should be understood that the inner peripheral layer 110, the outer peripheral layer 120, and two adjacent blocking portions 140 define one receiving cavity 101 together, the receiving cavity 101 is substantially in the shape of a sector-shaped ring, and correspondingly, the shape of each shaping plate 300 is substantially consistent with the shape of each receiving cavity 101, so that the shaping plate 300 and the receiving cavity 101 fit with each other more tightly. The annular sealing layer 130 is connected to both one end of the inner peripheral layer 110 and one end of the outer peripheral layer 120, that is, the annular sealing layer 130 seals one end of the annular space, an inner edge of the annular sealing layer 130 may be hermetically connected to the inner peripheral layer 110 in a heat-seal welding manner, and an outer edge of the annular sealing layer 130 may be hermetically connected to the outer peripheral layer 120 in a heat-seal welding manner. One end of each receiving cavity 101 is closed by the annular sealing layer 130, and the other end is open, and each shaping plate 300 can be inserted into a corresponding receiving cavity 101 from an end of the receiving cavity 101 away from the annular sealing layer 130. After each receiving cavity 101 is inserted with the corresponding shaping plate 300, one side of the inner peripheral layer 110 and one side of the outer peripheral layer 120 which are away from the annular sealing plate are both just hermetically connected to the sealing plate 200. The inner peripheral layer 110 and the outer peripheral layer 120 both may be fixedly connected to the sealing plate 200 in a heat-seal welding manner.

It should be noted that the inner peripheral layer 110 may be made of a material such as PVC (polyvinyl chloride). The shaping plates 300 may be rigid plastic plates or the like. The outer peripheral layer 120 may be made of a material such as netted sandwich fabric (Tarpauline).

It should be noted that, two ends of each blocking portion 140 may also have a distance from the two ends of the annular space, that is, the length of the blocking portion 140 is less than the height of the annular space, top portions of the plurality of receiving cavities 101 are communicated with each other, and bottom portions of the plurality of receiving cavities 101 are communicated with each other, in this way, the area of the blocking portion 140 is reduced, the processing technology for forming the blocking portion 140 is simpler, and the processing efficiency is improved.

Referring to FIG. 4, optionally, for ease of description, the enclosure body 100 has a first end 1001 and a second end 1002 that are arranged in an axial direction of the enclosure body, wherein the first end 1001 is connected to the sealing plate 200 to form a pool bottom end of the pool. The second end 1002 is an end where the annular sealing layer 130 is located. A plurality of operation ports 131 are provided on the second end 1002, i.e., on the annular sealing layer 130, wherein each operation port 131 is in a shape of a sector-shaped ring, so as to facilitate taking and placing the shaping plate 300. The number of operation ports 131 is equal to the number of receiving cavities 101, and the plurality of operation ports 131 are in one-to-one correspondence and communication with the plurality of receiving cavities 101. Meanwhile, a plurality of cover bodies 500 are arranged on an outer surface of the outer peripheral layer 120 of the enclosure body 100, and the number of the cover bodies 500 is equal to that of the operation ports 131 and the cover bodies 500 are matched with the operation ports 131 in one-to-one correspondence. The cover bodies 500 can move relative to the enclosure body, so as to open or close the operation ports 131, so that the operation ports 131 can be switched between an open state and a closed state. When the operation ports 131 are opened, it is convenient to take and place the shaping plates 300, and when the operation ports 131 are closed, the shaping plates 300 are not easy to come off from the receiving cavities 101, then the structure is more stable. Each cover body 500 is configured as a flexible member, for example, the cover body 500 may be configured as waterproof fabric, one side of the cover body 500 is fixedly connected to the outer peripheral layer 120, and the other side of the cover body 500 may be detachably connected to the enclosure body 100 by a velcro tape assembly, a button assembly, or a zipper assembly. For example, a secondary velcro tape may be provided on each cover body 500, and a primary velcro tape may be provided on an inner peripheral surface of the inner peripheral layer 110, then when the cover body 500 shields the operation port 131, the secondary velcro tape can be bonded and fixed to the primary velcro tape.

By means of the structural design of the cover bodies 500 and the operation ports 131, during the packaging, the sealing plate 200 and the enclosure body 100 are integrated as one piece, the plurality of shaping plates 300 are separated from the sealing plate 200 and the enclosure body 100, and the enclosure body 100, when being not shaped by the shaping plates 300, can be folded and has a small volume, in this way, it is convenient to transport the pool, and the transportation cost is reduced. After receiving the pool, the user unfolds the enclosure body 100 and opens the operation ports 131, then embeds one shaping plate 300 into each receiving cavity 101, and then closes the operation ports, thus the assembly of the pool can be completed. The operation is convenient and flexible, and is time-saving and labor-saving. Obviously, after all the shaping plates 300 are all assembled, it just needs to close the corresponding operation ports 131 by using the cover bodies 500.

Referring to FIG. 1 and FIG. 2, in the present embodiment, optionally, the pool further includes a reinforcement belt 600 and a plurality of limiting belts 700. The reinforcement belt 600 is a strip-shaped belt, which may be made of a material such as PVC, and two ends of the reinforcement belt 600 may be connected together, thus forming an annular structure. The number of limiting belts 700 is set as required. Each limiting belt 700 is a strip-shaped belt. Two ends of each limiting belt 700 are both welded and fixed to the outer peripheral surface of the outer peripheral layer 120 in a heat-seal welding manner, so that the limiting belt 700 and the outer peripheral layer 120 define a limiting through-hole together. Moreover, the limiting belts 700 extend in the axial direction of the annular space, in this way, axes of the limiting through-holes extend in the circumferential direction of the annular space. The reinforcement belt 600 passes through the plurality of limiting through-holes in sequence, and then two ends of the reinforcement belt are fixed, so that the reinforcement belt 600 is sheathed outside the outer peripheral layer 120, to function to stabilize the enclosure body and the plurality of shaping plates 300, and the pool is structurally more firm and more reliable.

It should be appreciated that the two ends of the reinforcement belt 600 can be detachably connected with each other by a quick buckle.

Referring to FIG. 1, in the present embodiment, optionally, the pool further includes a circulation pipe 800 and a filter pump 900 provided on the circulation pipe 800, and two ends of the circulation pipe 800 are both in communication with the water storage cavity 102. Optionally, end portions of the circulation pipe 800 both penetrate through the inner peripheral layer 110, the shaping plates 300, and the outer peripheral layer 120, so as to communicate with the water storage cavity 102. The two ends of the circulation pipe 800 have a height difference, wherein one end having a lower height is a water suction end 810, and the other end having a higher height is a water outlet end 820. After the filter pump 900 is started, the water in the water storage cavity 102 is sucked from the water suction end 810, and then is returned to the water storage cavity 102 from the water outlet end 820 after being filtered by the filter pump 900, so that the water in the water storage cavity 102 is cleaner.

The pool provided in the present embodiment can be split into a plurality of parts for transportation, has a small volume, is convenient to store, and reduces the transportation cost, moreover, the user can assemble the pool conveniently and flexibly and saves time and labor, and the pool is not prone to deformation during use, and has high stability and high safety.

The above-mentioned are merely for preferred embodiments of the present disclosure and not intended to limit the present disclosure, and for one skilled in the art, various modifications and variations may be made to the present disclosure. Any modifications, equivalent substitutions, improvements and the like made within the spirit and principle of the present disclosure should be covered within the scope of protection of the present disclosure.

INDUSTRIAL APPLICABILITY

For the pool provided in the embodiments of the present disclosure, by providing a plurality of shaping plates all in a plurality of receiving cavities of the enclosure body, the plurality of surfaces of the shaping plates can be all in contact with the enclosure body, so that the shaping plates and the enclosure body have a large contact area, and tightly fit with each other, the bonding between the shaping plates and the enclosure body is stable and reliable, the two are not easy to separate, thus the pool has high stability, and high safety during use. When the pool is in use, it is only necessary to position the sealing plate on the top surface or other supports, and then inject a certain amount of water into the water storage cavity.

What is claimed is:

1. A pool, comprising:

an enclosure body, a sealing plate, and a plurality of shaping plates, wherein the enclosure body is of an annular structure with two open ends, the enclosure body is provided with a plurality of receiving cavities in a circumferential direction thereof, and the plurality of shaping plates are respectively arranged in the plurality of receiving cavities in one-to-one correspondence, the enclosure body is connected to the sealing plate, and the sealing plate is configured to seal one of the two ends of the enclosure body, so that the enclosure body and the sealing plate define a water storage cavity together;

wherein the enclosure body has a first end and a second end in an axial direction thereof, the first end is connected to the sealing plate, the second end is provided with a plurality of operation ports configured to be capable of being switched between an open state and a closed state; and the plurality of operations ports are in one-to-one correspondence and communication with the plurality of receiving cavities;

wherein the enclosure body is provided with a plurality of cover bodies, the plurality of cover bodies are in one-to-one correspondence with the plurality of operation ports, and each of the cover bodies is configured to open or close a corresponding operation port;

wherein each of the cover bodies is provided as a flexible member, one side of the cover body is connected to the enclosure body, and the other side is detachably connected to the enclosure body by a velcro tape assembly, a button assembly, or a zipper assembly.

2. The pool according to claim 1, wherein the enclosure body comprises an inner peripheral layer, an outer peripheral layer, and an annular sealing layer, the outer peripheral layer is sheathed outside the inner peripheral layer, the inner peripheral layer and the outer peripheral layer define therebetween an annular space with two open ends, the annular sealing layer is connected to both the inner peripheral layer and the outer peripheral layer, so as to seal one end of the annular space; and the inner peripheral layer and the outer peripheral layer are both hermetically connected to the sealing plate, and the sealing plate is configured to seal the other end of the annular space.

3. The pool according to claim 2, wherein a plurality of blocking portions arranged in a circumferential direction of the annular space are provided between the inner peripheral layer and the outer peripheral layer, and the inner peripheral layer, the outer peripheral layer, and two adjacent blocking portions together define one of the receiving cavities.

4. The pool according to claim 3, wherein the blocking portions are provided as welding seams, bonding seams, or stitching seams.

5. The pool according to claim 1, wherein the pool further comprises a reinforcement belt, and the reinforcement belt is sheathed outside an outer peripheral surface of the enclosure body.

6. The pool according to claim 5, wherein a plurality of limiting belts are provided on the outer peripheral surface of the enclosure body, the plurality of limiting belts are arranged at intervals in the circumferential direction of the enclosure body, each of the limiting belts and the enclosure body together define a limiting through-hole, and the reinforcement belt passes through the plurality of limiting through-holes, so as to limit displacement of the reinforcement belt in an axial direction of the enclosure body.

7. The pool according to claim 1, wherein the pool further comprises a circulation pipe and a filter pump provided on the circulation pipe, and two ends of the circulation pipe are both in communication with the water storage cavity.

8. The pool according to claim 1, wherein a step is provided at a bottom of the sealing plate, and is configured to allow that a shallow water area and a deep water area can be formed in the pool after water injection.

9. The pool according to claim 3, wherein each of the blocking portions is of a strip-shaped structure, and extends in an axial direction of the annular space.

10. The pool according to claim 3, wherein a length of each of the blocking portions is less than a height of the annular space.

11. The pool according to claim 1, wherein each of the shaping plates has a shape substantially consistent with that of a corresponding receiving cavity.

12. The pool according to claim 2, wherein an inner edge of the annular sealing layer is hermetically connected to the inner peripheral layer in a heat-seal welding manner, and an outer edge of the annular sealing layer is hermetically connected to the outer peripheral layer in a heat-seal welding manner.

13. The pool according to claim 1, wherein in the two ends of the circulation pipe, one end having a lower height is a water suction end, and is configured to suck water in the water storage cavity after the filter pump is started, and the other end having a higher height is a water outlet end, and is configured to discharge the water sucked from the water suction end and filtered by the filter pump, to return the water to the water storage cavity.

* * * * *